United States Patent [19]

Holtz

[11] Patent Number: 4,549,381

[45] Date of Patent: Oct. 29, 1985

[54] COMPOSITE JOIST SYSTEM

[76] Inventor: Neal Holtz, 1900 Lyttonsville Dr., #716, Silver Spring, Md. 20910

[21] Appl. No.: 548,187

[22] Filed: Nov. 2, 1983

[51] Int. Cl.[4] ..... E04B 1/16

[52] U.S. Cl. ..... 52/337; 52/665; 52/714; 52/741

[58] Field of Search ..... 52/337, 338, 340, 694, 52/665, 714, 741, 692; 249/23, 28, 211

[56] References Cited

U.S. PATENT DOCUMENTS

| | | | |
|---|---|---|---|
| 1,725,501 | 8/1929 | Yeager . | |
| 1,766,181 | 6/1930 | Macomber | 52/692 X |
| 2,731,701 | 1/1956 | Klausner . | |
| 3,093,932 | 6/1963 | Dreier et al. . | |
| 3,195,209 | 7/1965 | Klausner . | |
| 3,307,304 | 3/1967 | Klausner . | |
| 3,362,121 | 1/1968 | Weber . | |
| 3,500,604 | 3/1970 | Vandall . | |
| 3,841,597 | 10/1974 | Butts et al. . | |
| 3,845,594 | 11/1974 | Butts et al. . | |
| 3,888,452 | 6/1975 | Anderson . | |
| 3,917,215 | 11/1975 | Fox . | |
| 3,945,168 | 3/1976 | Butts et al. . | |
| 3,979,868 | 9/1976 | Butts et al. . | |
| 3,993,282 | 11/1976 | Berman et al. . | |
| 4,015,396 | 4/1977 | Butts et al. . | |
| 4,056,908 | 11/1977 | McManus . | |
| 4,080,712 | 3/1978 | Weber . | |

*Primary Examiner*—Carl D. Friedman

[57] ABSTRACT

A T-shaped construction element for use in combination with an open web joist to support spanner bars, and a composite open web joist and concrete slab construction which results from the use of that combination.

9 Claims, 8 Drawing Figures

COMPOSITE JOIST SYSTEM

This invention relates to floor and roof constructions, and more particularly, to composite open web steel joist and concrete floor and roof constructions, and to methods of erecting formwork for pouring a slab in place on steel joists.

In some methods of constructing floors and roofs, steel joists are placed in position spanning structural supports therefor. The joists support panels, such as plywood sheets, which form the bottom member of a mould, and concrete is poured on the panels to form a slab. It is desirable to be able to reuse the panels after the concrete has hardened and the forms removed. This requuires that the forms be supported in such a way that they can be removed with little or no damage to them, and the prior art teaches a variety of techniques for supporting forms in such a way that they can be removed. However, some of the methods are not applicable to open web joist systems; some which may be used with open web joist systems are difficult to use in practice; some of the systems may raise safety questions; and some of these systems may not permit an extensive span between adjacent joists.

In one type of system, metal bars, referred to herein as spanner bars, extend between adjacent joists and provide support for the concrete forms. The prior art methods of supporting the spanner bars at the joists, especially at open joists, can present problems in assembly, disassembly, adjustability, adaptability to a variation in joist structure and safety.

SUMMARY OF THE INVENTION

It is accordingly one object of this invention to provide means for supporting a spanner bar from a joist which permits easy assembly and disassembly of the supporting member and the spanner bars.

It is another object to provide means for supporting a spanner bar which is readily adjustable in a longitudinal direction along a joist.

It is a further object to provide means for supporting a spanner bar which requires an external force to release the bar.

A further object of the invention is to provide means for supporting a spanner bar wherein the forces produced in the supporting means by the spanner bar are essentially tensile forces.

It is another object of this invention to provide an improved method of erecting formwork for pouring a slab in place on open web joists.

It is another object to provide an improvement in formwork used for pouring concrete floors and ceilings.

It is a further object to provide a composite metal joist and concrete system for a roof or floor construction wherein the joists are open web joists and a poured concrete slab extends between adjacent joists and encloses the top portion of the joist.

It is still another object of the invention to provide an open web joist having a top chord which is readily encased in concrete, thus forming an integral structure with the concrete.

Other objects of this invention will be obvious from the drawings and the detailed description of the invention.

In accordance with this invention, there has been provided a T-shaped clip for use in supporting one end of a spanner bar, said clip comprising:

a horizontal plate member;

a vertical plate member integral with said horizontal member;

said vertical plate member comprising means for releasably supporting one end of a spanner bar.

Further in accordance with this invention there has been provided an open web joist having a top chord, a bottom chord, and an open web joining and separating said top chord and said bottom chord, said top chord comprising two parallel metal bars welded to opposite sides of said open web, at least one of said metal bars having a circular cross-section.

Further, in accordance with this invention, there has been provided a combination of (1) an open web joist having a top chord, a bottom chord and an open web joining and separating said top chord and said bottom chord, said top chord comprising two parallel metal bars welded to opposite sides of said open web, and (2) a T-shaped clip having a horizontal member and a vertical member integral therewith, said horizontal member being supported by said top chord, and said vertical member disposed between the two bars composing said top chord and extending into the open web.

There has also been provided a roof or floor structure comprising a combination of open web joists, T-clips adapted to be supported by the top chord or the joists, and a poured concrete slab enclosing the top chord of said joists and at least a portion of the T-clips.

This invention provides a system for supporting the bottom member of a concrete form from joists wherein the forms can be readily removed in a condition for reuse. The use of spanner bars in the system permits a greater distance between the joists than is usual without spanner bars. Optionally, means are provided for retaining the spanner bars securely in a longitudinal as well as a lateral direction. The forces exerted on the T-clip means for supporting the spanner bar are essentially tensile forces, i.e., there are no significant forces tending to bend the spanner retaining means. Further, the T-clip is inexpensive to fabricate, and leaving it in place as a part of the concrete-joist assembly does not add significantly to costs. Since a T-clip is not an integral part of the joist, it can be positioned at various desired locations along the joist, such as to provide additional support where needed.

In one embodiment of the invention, at least one bar of the top chord is a reinforcing bar having a circular cross-section. This structure of the top chord enables the concrete to flow around and encase the top chord with a minimum of voids, thus providing a strong bond between the concrete slab and the joist.

DETAILED DESCRIPTION OF THE INVENTION

T-Clip

Figure 1:
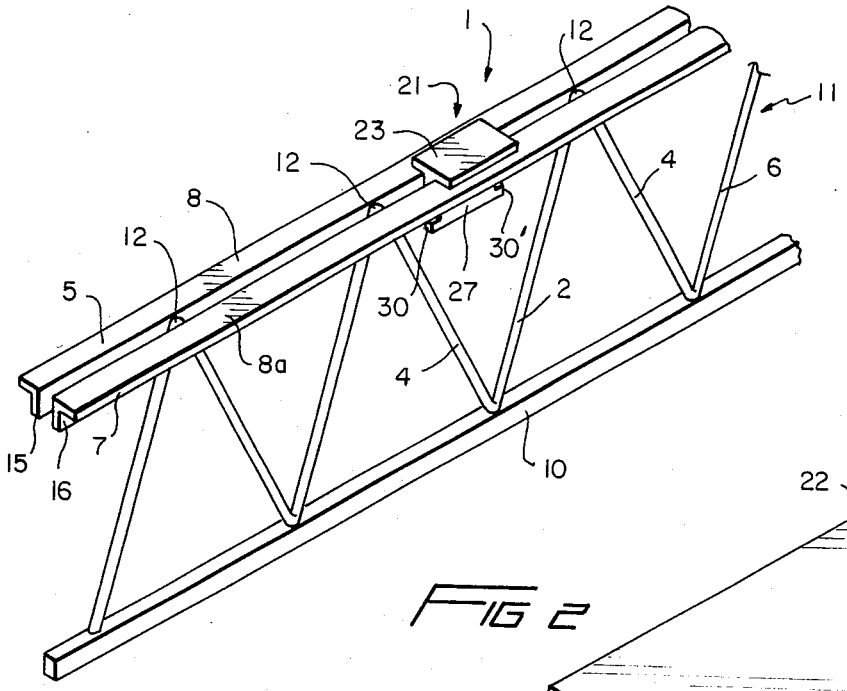
FIG. 1 is a perspective view of an open web joist and a T-clip in place on the top chord.
Figure 2:
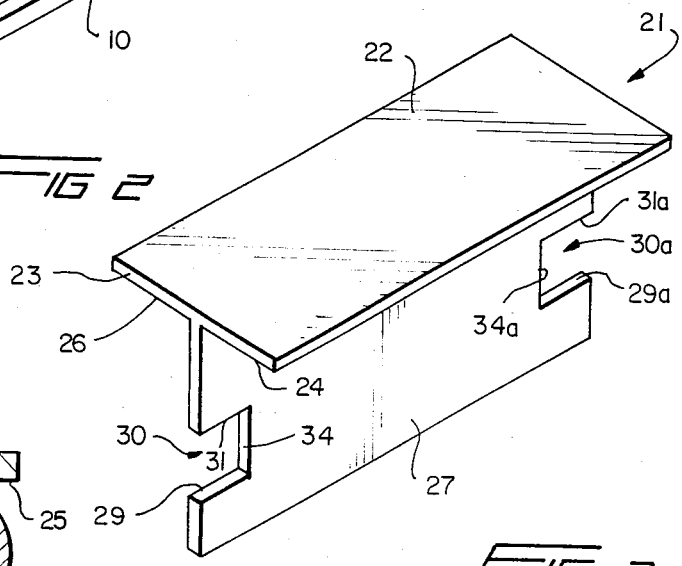
FIG. 2 is a perspective view of one embodiment of a T-clip.
Figure 5:
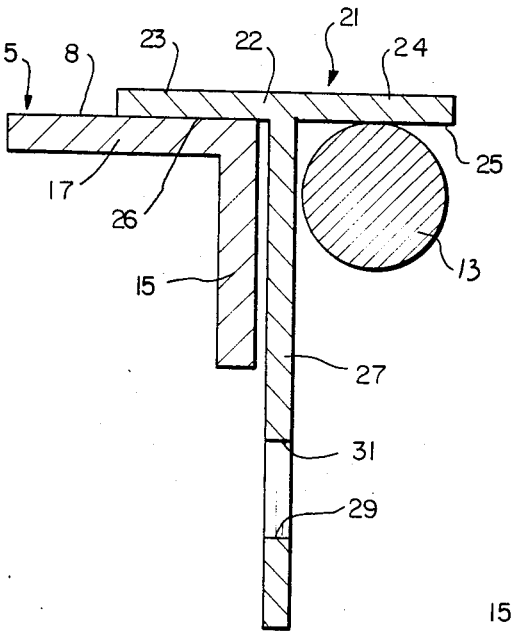
FIG. 5 is an end view of a combination of the top chord of a preferred embodiment of the open web joist and the embodiment of the T-clip shown in FIG. 2.
Figure 3:
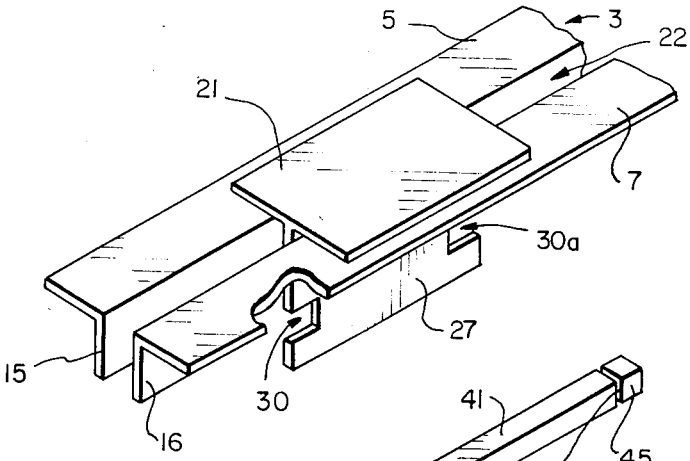
FIG. 3 is an enlarged perspective view of a T-clip and the top chord of an open web joist.

Referring to the drawings, FIG. 1 shows a T-clip 21 being supported by top chord 3 of open web steel joist 1. FIG. 3 shows more detail of a T-clip in place on the top chord 3; FIG. 2 shows additional detail of the T-clip itself; and, FIG. 5 shows a cross-section of a T-clip in place on an alternate embodiment of the top chord of an open web steel joist.

T-clip 21 comprises vertical plate 27 and horizontal plate 22, plate 27 being joined, as by welding, to plate 22 at about the centerline of plate 22 to form two legs 23, 24 having undersurfaces 25, 26 for resting upon upper surfaces 5, 7 of top chord 3. Top plate 22 must be sufficiently wide so that it can be supported by bars 5, 7 and must be sized to have sufficient strength to support the weight that will be applied to it. Vertical plate 27 is adapted to be placed in the zone between bars 5, 7 of the top chord and extends downwardly beyond vertical legs 15, 16 of bars 5, 7 so that apertures 30, 30*a* in vertical plate 27 are below the lower edge of legs 15, 16 of the top chord.

Referring to FIG. 2, apertures 30, 30*a* are defined by lower surfaces 29, 29*a*, upper surfaces 31, 31*a* and inner surfaces 34, 34*a*. Apertures 30, 30*a* are sized so that a spanner bar can be inserted therein. Preferably, surfaces 29, 29*a* are substantially parallel to horizontal plate 22. Upper aperture surfaces 31, 31*a* may also be substantially parallel to top plate 22; however, upper surfaces 31, 31*a* may deviate from the horizontal such as to provide apertures which taper inwardly. In this embodiment, the spanner bar may be secured in place by inserting a wedge between the top surface of the spanner bar and upper surfaces 31, 31*a*.

T-clips having means for supporting spanner bars other than apertures are contemplated. For example, the vertical plate of the T-clip may be provided with means for bolting a spanner bar in place, or means for suspending a hanger assembly. However, inasmuch as the T-clip is to be imbedded in the concrete slab, and thus sacrificed, a simple inexpensive structure is preferred, and those shown are easy to fabricate and require no skilled labor in the assembly and disassembly of the concrete forms.

In the preferred embodiment of the T-clip, there are at least two apertures for supporting spanner bars. See FIG. 2. The configuration of FIG. 2 will accommodate two spanner bars, one at each side of the joist. However, the invention contemplates T-clips having means for supporting only one spanner bar, since some joists, such as those at the edge of a building, need support only one end of a spanner bar. Further, it may be desirable in some instances to have two T-clips, each with means for supporting only one spanner bar, disposed near each other at a joist.

Figure 4:
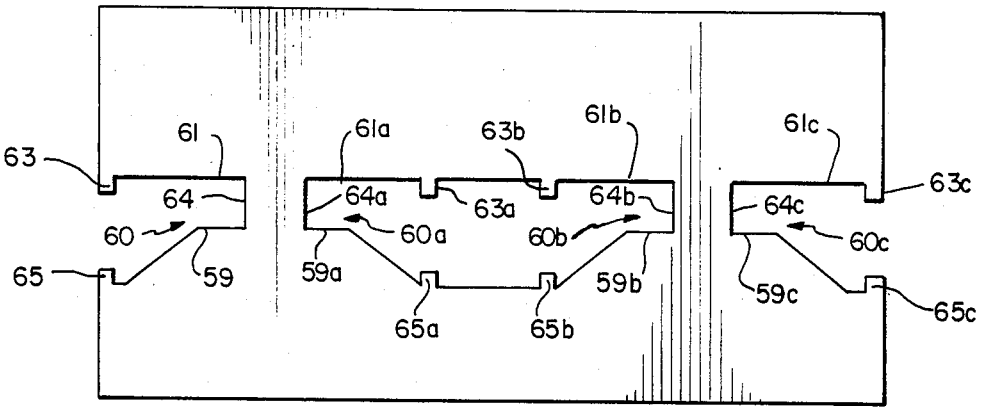
FIG. 4 is a plan of the vertical plate of a preferred embodiment of a T-clip.

FIG. 4 shows a plan view of the vertical section of a preferred embodiment of the T-clip. This embodiment has the advantages that means are provided for supporting spanner bars at four separate locations; means are provided for cooperating with wedge means to secure the spanner bar in position; and, means are provided for retaining a spanner bar which has been loosened in the process of disassembling forms from a poured concrete slab. Considering FIG. 4 in detail, vertical plate 27*a* is provided with four apertures 60, 60*a*, 60*b* and 60*c*. Each aperture is sized to fit a spanner bar and is defined by lower surfaces 59, 59*a*, 59*b* and 59*c*, upper surfaces 61, 61*a*, 61*b* and 61*c*, and inner vertical surfaces 64, 64*a*, 64*b* and 64*c*. When the spanner bar is in place, for example, in aperture 60, it can be secured in place by means such as a wedge or restraining bar (not shown) extending between stud 63 and the outer edge of the spanner bar. Stop 65 is provided to retain the spanner bar on the T-clip when the spanner bar is moved from the aperture 60 during disassembly of the forms. The distance between inner vertical edges 64 and 64*a* and that between 64*b* and 64*c* must be adequate to provide the strength needed to support the anticipated load. The length of the vertical plate is not critical; however, it must be short enough so that it will fit between diagonals 4, 2 of web 11 (see FIG. 1). A typical embodiment may have a length of about 10 inches with a minimum spacing of about 1½ between adjacent apertures and a maximum spacing between apertures of about 7 inches. A multi-apertured T-clip such as is depicted in FIG. 4 provides flexibility in the positioning of spanner bars. In the embodiment shown, spanner bars inserted and released from openings 60*a* and 60*b* would be retained on the T-clip even in the absence of stud 65*a*, 65*b*. However, these studs would be particularly useful if the T-clip were cut into two portions to provide two separate T-clips.

The T-clip may be made of any material capable of withstanding the forces to be exerted, and is preferably made of metal, such as a low carbon steel.

Joist

The joist for use with the T-bar must be an open web steel joist having as a top chord a pair of spaced-apart steel bars. In FIG. 1, which shows one embodiment of an open web steel joist which may be used, top chord 3 comprises a pair of steel angle bars 5, 7 which are secured, as by welding, to web 11 on opposite sides and adjacent the peak 12 of web 11. The peak 12 of web 11 may lie at about the same elevation as the top surfaces 8, 8*a* of bars 5, 7, or may extend above the top surfaces or may be below the top surfaces. In a preferred embodiment, the peak 12 of the web is at about the same level as upper surfaces 8, 8*a* of bars 5, 7. The bottom chord 9 comprises a steel member 10 which may suitably be either a channel or a pair of angle irons such as comprise the top chord 3. The web 11 comprises a steel bar 6 which is formed into diagonals 4 and 2. The bar may be a continuous piece which is bent into the proper shape or may comprise individual pieces of bar stock for each diagonal.

Figure 7:
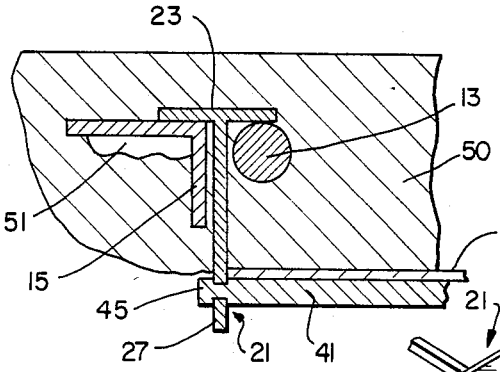
FIG. 7 is a sectional view of a composite metal joist and concrete slab with a spanner bar and bottom panel of the concrete form in place.
Figure 8:
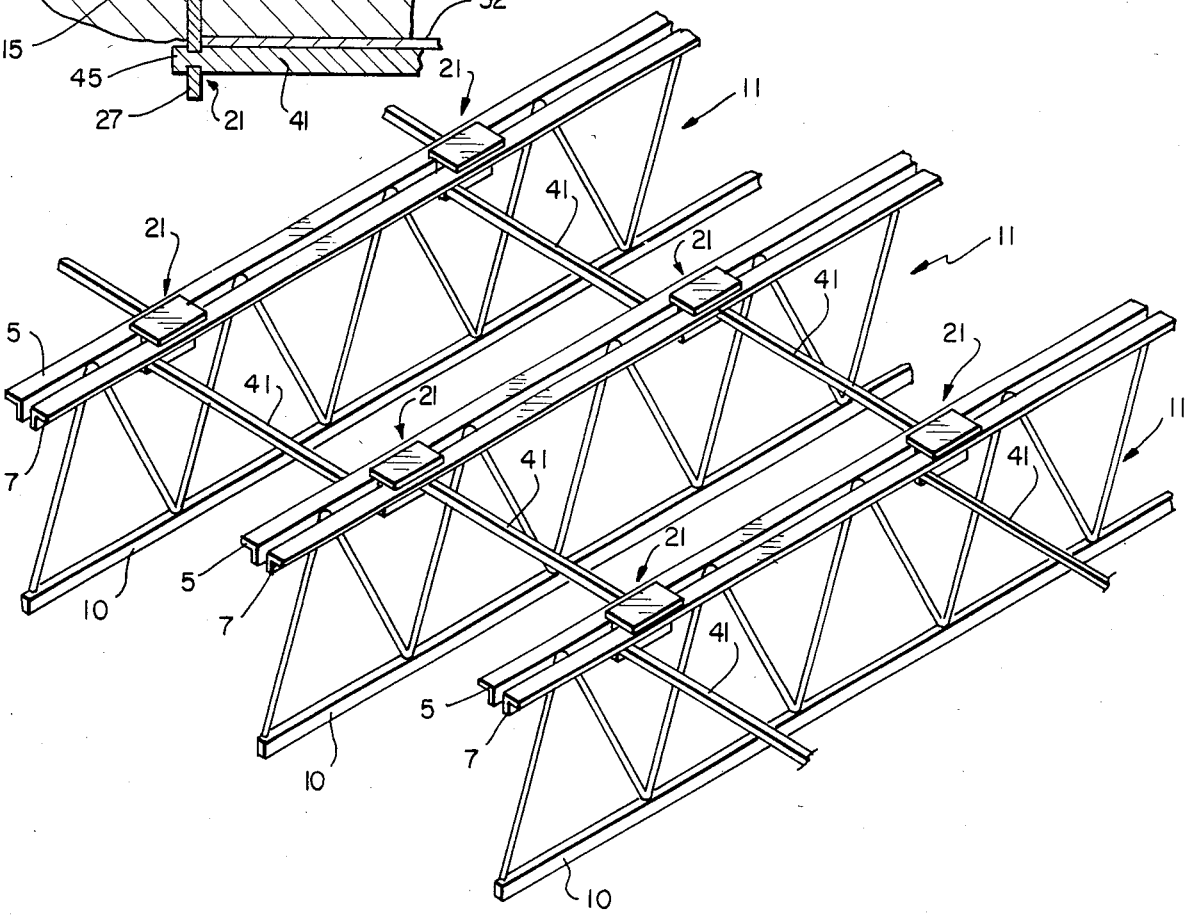
FIG. 8 is a perspective view of an assembly of three open web joists showing spanner bars supported by T-clips.

FIGS. 5 and 7 show a preferred embodiment of the open web joist in which one of the angle bars is replaced by round bar stock 13. This substitution of round bar stock for at least one of the angle bars results in a more highly integrated assembly of the joists and concrete slab since the concrete can more readily flow around and make contact with the round bar surfaces than it can with the flat surfaces and inner corner surfaces of angle bars. The round bar stock is preferably bar stock such as is used as reinforcing in concrete since reinforcing bar stock has a rough surface which forms a stronger bond with concrete than would bar stock having a smooth surface.

The use of round bar stock 13 as at least one bar of the chord has the additional advantage that its relatively small diameter (compared to the width of a leg of an angle bar) permits a plywood panel to be placed on the spanner bars with a relatively small gap between the edge of the plywood sheet and the web 11.

The sizes of the joist and joist components are not critical in the practice of this invention and are established by factors outside the scope of the invention, such as the building height (which may restrict the depth of the joist), the distance to be spanned by the joist, and the live load to be applied to the joist. For example, round bar stock for the upper chord may suitably have a diameter from about $\frac{1}{8}$ inch to about 2 inches and the distance between adjacent peaks 12 of the web may range from about 3 to about 48 inches. A reinforcing bar $\frac{5}{8}$ inch in diameter has been found to be useful in combination with an angle bar having legs 2 inches on a side for a 16 inch deep joist having one inch diameter round bar stock as webbing. Workers in the art can readily determine the desired size of the joist components from the ultimate force to be applied to the joists.

FIG. 7 shows a cross-section view of an embodiment of a preferred joist having round bar stock 13 as one member of the upper chord. As is shown, this joist is imbedded in concrete 50 which has been poured on mould panel 52 which is supported in turn by spanner bar 41 held in place by vertical plate member 27 of T-clip 21. FIG. 7 also exemplifies the superior integration of concrete with round bar stock as compared with angle irons by depicting void 51 which is typical of voids which may exist at the inner angle of the intersection of horizontal member 5 and vertical leg 15 of angle bar 5.

Spanner Bar

Spanner bars are not novel and have been used in the prior art so that the distance between adjacent joist members can be increased. By the use of spanner bars, the distance between adjacent joists may be as great as 4 feet or even greater. A distance of 4 feet is particularly useful because this enables the construction industry to use standard 4 feet wide plywood sheets as the bottom portion of the forms without cutting the plywood into smaller pieces. The ability to use entire sheets of plywood is advantageous in that (1) the bottom of the forms can be assembled without skilled labor; and (2) the entire sheets of plywood which are removed after the concrete has set are in general more useful for reuse than partial sheets would be.

Figure 6:
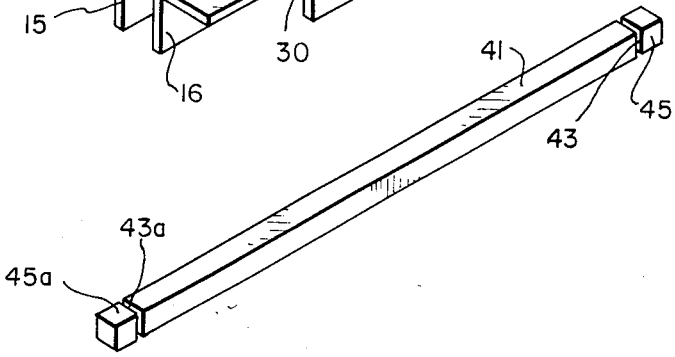
FIG. 6 is a perspective view of a preferred embodiment of a spanner bar.

A typically useful spanner bar will have a length sufficient so that it can be supported between aligned T-clips on adjacent joists, and spanner bars having a width and depth each of about $\frac{3}{4}$ of an inch have been found to be useful. FIG. 6 shows a preferred embodiment of spanner bar 41 for use with the T-clip of this invention. Spanner bar 41 is provided with grooves 43, **43*a* which are sized and spaced apart to mate with the surfaces forming the apertures 30, 30*a* in vertical plate 27 of T-clip 21**. These grooves restrict the longitudinal movement of the spanner bar and help keep it in place on the T-clip. The width of these grooves is not critical, and at least one may be sufficiently wide, as for example several inches, to accommodate slight variations in the spacing of joists. As alternatives to the means shown for preventing longitudinal movement of the spanner bar, a groove may be provided on only one end of the spanner bar, or a boss at least at one end of the bar may be used to restrict its longitudinal movement.

The spacing of the spanner bars along the joists is established by the load to be applied, and is readily determined by workers in the art. For example, adjacent spanner bars may be distributed along the joists at intervals of from about 2 to about 36 inches.

Practice of the Invention

In a typical method of practicing the invention, open web steel joists are placed on supports in accordance with conventional construction practice. However, in view of the use of spanner bars, the joists can be spaced further apart than is typical for construction not using spanner bars. Also, there is no necessity for ensuring that corresponding elements of adjacent joists are aligned as might be required for joists having means for supporting spanner bars as an integral part of the joist. The T-clips are placed on the top chords of the joists and are adjusted longitudinally so that apertures of T-clips on adjacent joists are aligned to support the spanner bars. Spanner bars are then inserted into the apertures in the T-clips and are secured in place as by use of wedges. Plywood panels are then placed on the spanner bars, reinforcement for the concrete is put in place, and concrete is poured. After the concrete has set, and has sufficient strength to support itself, the wedges holdin the spanner bars in place on the T-clips are removed and the spanner bars are forced out of the apertures in the T-clips. The plywood panels forming the bottom of the concrete form are then stripped from the concrete.

The above description is merely illustrative and not restrictive of this invention, which is defined by the following claims:

What is claimed is:

1. A method of erecting formwork for pouring a slab in place on substantially parallel steel joists, each joist being in the form of a truss having an open web, a top chord and a bottom chord, said top chord comprising a pair of spaced-apart parallel metal bars welded to opposite sides of said web, said method comprising:

installing a plurality of T-shaped spanner bar support clips at spaced-apart positions on said joists, each of said support clips being substantially aligned with at least one support clip at an adjacent joist, each of said support clips comprising a horizontal plate member adapted to be supported on the top chord by the upper surface of said spaced-apart metal bars, a vertical plate member adapted to extend between said spaced-apart metal bars into the open web portion of said joist, and aperture means in said vertical plate member to accommodate and support a spanner bar;

inserting opposite ends of spanner bars into the aperture means of aligned support clips; and placing concrete form panels on said spanner bars.

2. The method according to claim 1 wherein the spanner bars are placed about 2 to about 36 inches apart.

3. The method according to claim 1 wherein the steel joists are about 4 feet apart.

4. The method according to claim 1 wherein the concrete form panels comprise 4′×8′ plywood sheets.

5. Formwork for pouring a concrete slab for an integral concrete slab-open web joist structure, said open web joist comprising an open web, a top chord and a bottom chord, said top chord comprising a pair of spaced-apart parallel metal bars welded to opposite sides of said open web, said formwork comprising:

(a) a plurality of aligned T-clips positioned on said joists and supported from said top chord, said T-clips comprising horizontal plate members supported by said top chord, and vertical plate members integral with said horizontal plate members and depending into said open web;

(b) spanner bars supported by said T-clips; and (c) bottom form panels supported by said spanner bars.

6. The formwork of claim 5 wherein said joists are spaced apart a distance of about 4 feet.

7. The formwork of claim 5 wherein each of said T-shaped spanner bar support clips contain aperture means for supporting the end portions of at least two spanner bars.

8. The formwork of claim 5 wherein said form panels comprise 4′ by 8′ plywood sheets.

9. The formwork of claim 5 wherein at least one of said metal bars comprising said top chord is a round steel bar.

* * * * *